US011555388B2

(12) United States Patent
Stojkovic et al.

(10) Patent No.: US 11,555,388 B2
(45) Date of Patent: Jan. 17, 2023

(54) SELF-ADJUSTING GAS LIFT SYSTEM

(71) Applicant: ExxonMobil Upstream Research Company, Spring, TX (US)

(72) Inventors: Dragan Stojkovic, Spring, TX (US); Michael C. Romer, The Woodlands, TX (US); Federico G. Gallo, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 221 days.

(21) Appl. No.: 17/014,289

(22) Filed: Sep. 8, 2020

(65) Prior Publication Data

US 2021/0131238 A1 May 6, 2021

Related U.S. Application Data

(60) Provisional application No. 62/928,039, filed on Oct. 30, 2019.

(51) Int. Cl.
*E21B 34/08* (2006.01)
*E21B 43/12* (2006.01)

(52) U.S. Cl.
CPC ..... *E21B 43/123* (2013.01); *E21B 34/08* (2013.01); *E21B 2200/04* (2020.05)

(58) Field of Classification Search
CPC ..... E21B 34/08; E21B 43/123; E21B 2200/04
See application file for complete search history.

(56) References Cited

U.S. PATENT DOCUMENTS 2,144,144 A * 1/1939 Crickmer ..... E21B 43/123 417/189
2,478,483 A * 8/1949 Hartman ..... E21B 43/123 417/117
3,523,744 A * 8/1970 Holladay, Jr. ..... E21B 43/123 417/115
3,654,949 A * 4/1972 McMurry ..... E21B 43/123 417/112
3,888,273 A * 6/1975 Douglas ..... E21B 43/123 417/115

(Continued)

FOREIGN PATENT DOCUMENTS

CN 202500533 10/2012
EP 2077374 A1 7/2009

(Continued)

*Primary Examiner* — Matthew R Buck
(74) *Attorney, Agent, or Firm* — ExxonMobil Upstream Research Company—Law Department

(57) ABSTRACT

A self-adjusting gas lift system and corresponding self-adjusting gas lift valve (GLV) are described herein. The self-adjusting gas lift system includes a number of self-adjusting GLVs that fluidically couple an annulus of a well to an interior of a production tubing of the well. Each of the self-adjusting GLVs is configured to open to allow a compressed gas to flow from the annulus to the interior of the production tubing when a pressure differential between an injection pressure of the compressed gas within the annulus and a production pressure of fluids within the production tubing is within an engineered range. Each of the self-adjusting GLVs is also configured to close when the pressure differential is outside the engineered range.

19 Claims, 10 Drawing Sheets

(56) References Cited

U.S. PATENT DOCUMENTS

| | | | | |
|---|---|---|---|---|
| 6,328,102 | B1 | 12/2001 | Dean | |
| 7,111,675 | B2 | 9/2006 | Zidk, Jr. | |
| 7,322,803 | B2 | 1/2008 | Vogeley | |
| 7,484,940 | B2 | 2/2009 | O'Neill | |
| 7,597,150 | B2 | 10/2009 | Clem | |
| 8,133,041 | B2 | 3/2012 | Ludlow et al. | |
| 8,511,390 | B2 | 8/2013 | Coyle et al. | |
| 9,453,398 | B1 * | 9/2016 | Zhang | E21B 43/123 |
| 2002/0197174 | A1 | 12/2002 | Howard | |
| 2003/0010491 | A1 | 1/2003 | Collette | |
| 2006/0198742 | A1 | 9/2006 | DiFoggio et al. | |
| 2008/0080991 | A1 | 4/2008 | Yuratich et al. | |
| 2009/0183879 | A1 | 7/2009 | Cox | |
| 2009/0218091 | A1 | 9/2009 | Dotson | |
| 2010/0012313 | A1 | 1/2010 | Longfield | |
| 2012/0263606 | A1 | 10/2012 | Bouldin et al. | |
| 2017/0314374 | A1 * | 11/2017 | Lundberg | F16K 31/1221 |

FOREIGN PATENT DOCUMENTS

| | | | |
|---|---|---|---|
| GB | 2393747 | A | 4/2004 |
| GB | 2403752 | A | 1/2005 |
| WO | 01/20126 | A2 | 3/2001 |
| WO | 2009/077714 | A1 | 6/2009 |
| WO | 2011/079218 | A2 | 6/2011 |

* cited by examiner

[Prior Art]

100

[Prior Art]

100

200

214

224

224

300

224

500

SELF-ADJUSTING GAS LIFT SYSTEM

CROSS-REFERENCE TO RELATED APPLICATION

This application claims the benefit of U.S. Provisional Application 62/928,039 filed Oct. 30, 2019 entitled SELF-ADJUSTING GAS LIFT SYSTEM, the entirety of which is incorporated by reference herein.

FIELD

The techniques described herein relate to the field of well completions and downhole operations. More particularly, the techniques described herein relate to a self-adjusting gas lift system including a number of self-adjusting gas lift valves (GLVs).

BACKGROUND

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

During the drilling of a well, large diameter wellbores are cased leading to narrow diameter wellbores which are also cased, finally leading to the production zones in the reservoir. As each section is cased, concrete is injected around the casing to hold it in place. The well is then completed by operations to begin the production of hydrocarbon fluids from the reservoir. The completions include the formation of perforations through the casing and concrete of the final section into the reservoir using a perforation gun. Production tubing is then inserted down the wellbore into the production zone. The production tubing may include equipment that enables the use of artificial lift to remove the hydrocarbon fluids from the reservoir.

Artificial lift includes a number of methods for transporting produced hydrocarbon fluids to the surface when reservoir pressure alone is not sufficient. Gas lift is a common method that is particularly suited to high-volume offshore wells. A high-pressure gas is injected into the production tubing via the casing annulus. The high-pressure gas then travels to a number of gas lift valves (GLVs). The GLVs provide a pathway for a designed volume of injected gas to enter the production tubing. This decreases the density of the fluid column, thereby decreasing the backpressure on the production zones in the reservoir. The available reservoir pressure can then force more hydrocarbon fluids to the surface.

GLVs are effectively pressure regulators and are typically installed during well completion. In many cases, a number of "unloading valves" are used to remove completion fluid from the annulus so that the injected gas can reach the final "operating valve." Once the injected gas reaches the operating valve, the operating valve is ideally the only GLV left open. Gas entering the operating valve may then assist in the production of hydrocarbon fluids from the reservoir.

Gas lift is an effective artificial lift method, and gas lift wells are typically low maintenance. However, gas lift wells still function even when they are not optimized. Specifically, wells typically still flow, albeit at a reduced production rate, even if they are receiving too much (or too little) lift gas and/or are lifting from multiple GLVs or a valve that is shallower than the desired operating point, i.e., an unloading valve instead of the desired operating valve. Field diagnostics and modeling have estimated that less than 25% of gas lift wells are truly optimized.

A common mode of sub-optimal gas lift production is multipointing. Multipointing is a condition in which two or more GLVs are open and allowing gas passage simultaneously. Multipointing can be caused by higher than optimal injection pressure, improper unloading valve placement or design, failed reverse-flow check valves, and/or other equipment or operational issues. In many cases, multipointing results in a higher flowing bottomhole pressure and sub-optimal production since some of the gas is not being injected into the deepest possible point in the well, i.e., some of the gas is passing through one or more unloading vales rather than the desired operating valve. This may result in an increased average production pressure gradient, injection gas interference, and, in some cases, increased friction pressure in the production conduit. In addition, rapid fluctuations in the injection pressure can cause the stem of a GLV to be repeatedly lifted off the seat and then reseated immediately thereafter. This is referred to a valve "chattering." Chattering can damage the stem and seat of the GLV and, thus, deteriorate the GLV's performance.

Because multipointing is difficult to diagnose without using additional surveillance, testing, and well modeling, it often continues unnoticed for a while. Over time, multipointing and associated valve chattering can damage the GLVs within the gas lift system. Moreover, the work required to correct the problem can be quite expensive, especially in an offshore environment.

SUMMARY

An embodiment described herein provides a self-adjusting gas lift system. The self-adjusting gas lift system includes a number of self-adjusting gas lift valves (GLVs) that fluidically couple an annulus of a well to an interior of a production tubing of the well. Each of the self-adjusting GLVs is configured to open to allow a compressed gas to flow from the annulus to the interior of the production tubing when a pressure differential between an injection pressure of the compressed gas within the annulus and a production pressure of fluids within the production tubing is within an engineered range. Each of the self-adjusting GLVs is also configured to close when the pressure differential is outside the engineered range.

Another embodiment described herein provides a method for lifting hydrocarbon fluids from a well using a self-adjusting gas lift system. The method includes removing completion fluid from a well by injecting a compressed gas into a production tubing of the well via a number of self-adjusting GLVs installed along a length of the production tubing. The compressed gas flows through each of the self-adjusting GLVs when a pressure differential between an injection pressure of a compressed gas within the annulus and a production pressure of hydrocarbon fluids within the production tubing is within an engineered range. The method also includes lifting the hydrocarbon fluids within the production tubing to the surface by injecting the compressed gas into the production tubing via an operating valve installed at a desired operating point.

Another embodiment described herein provides a well completion. The well completion includes a number of self-adjusting GLVs that fluidically couple an annulus of a well to an interior of a production tubing of the well. The self-adjusting GLVs are configured to optimize a production of hydrocarbon fluids from the well by automatically opening and closing based on a pressure differential between an injection pressure of a compressed gas within the annulus and a production pressure of the hydrocarbon fluids within the production tubing.

Another embodiment described herein provides a self-adjusting GLV. The self-adjusting GLV includes an injection port, a differential valve, and a reverse-flow check valve. The differential valve is configured to allow a compressed gas to flow through the injection port when a pressure differential acting upon the differential valve is within an engineered range, and prevent the compressed gas from flowing through the injection port when the pressure differential acting upon the differential valve is outside the engineered range. The reverse-flow check valve is configured to prevent fluids from flowing backwards through the injection port.

DESCRIPTION OF THE DRAWINGS

The foregoing and other advantages of the present techniques may become apparent upon reviewing the following detailed description and drawings of non-limiting examples in which.

Figure 1A:
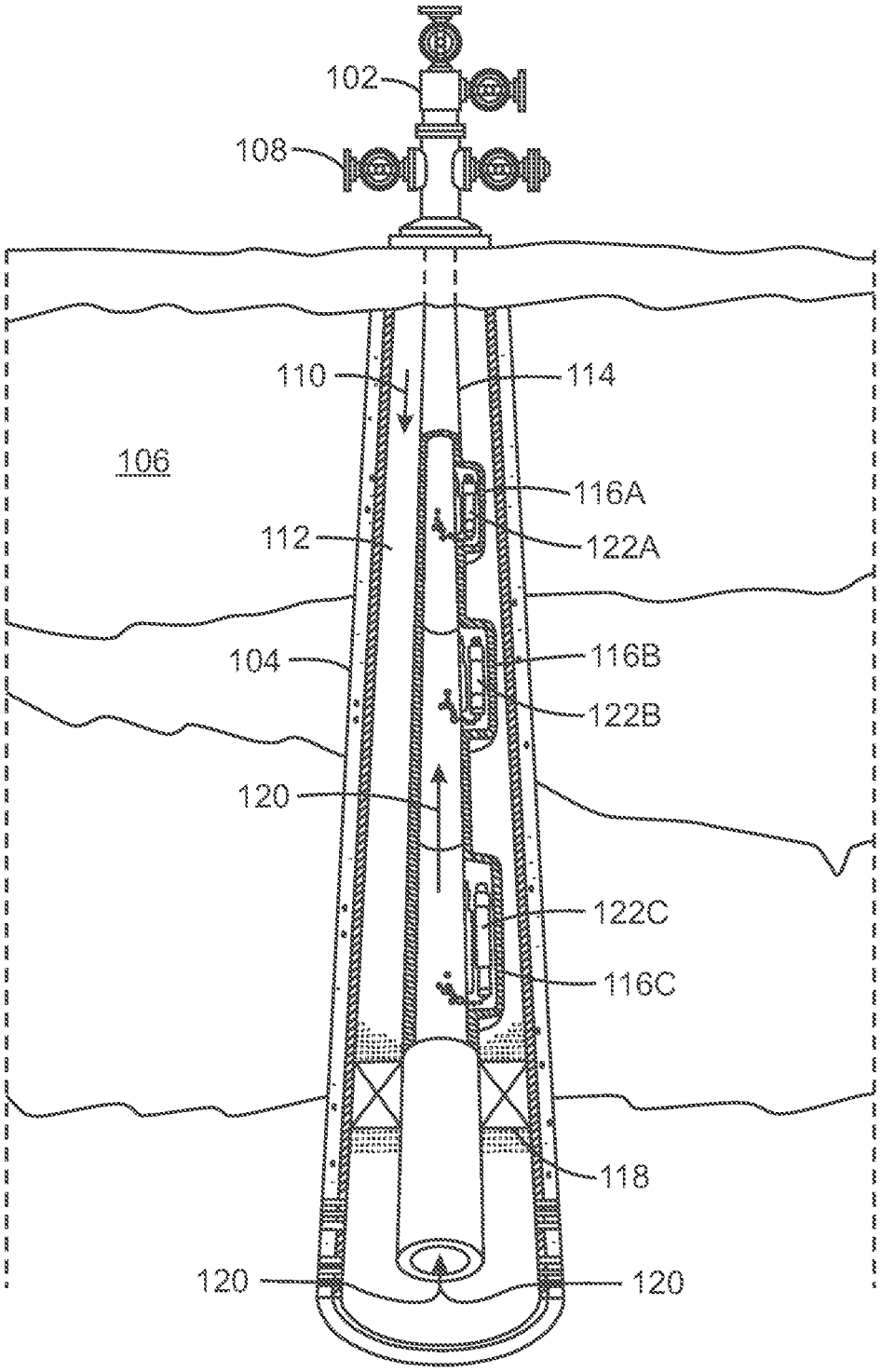
FIG. 1A is a schematic view of a well including a conventional gas lift system.

It should be noted that the figures are merely examples of the present techniques, and no limitations on the scope of the present techniques are intended thereby. Further, the figures are generally not drawn to scale, but are drafted for purposes of convenience and clarity in illustrating various aspects of the techniques.

DETAILED DESCRIPTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the terms "a" and "an" mean one or more when applied to any embodiment described herein. The use of "a" and "an" does not limit the meaning to a single feature unless such a limit is specifically stated.

The terms "about" and "around" mean a relative amount of a material or characteristic that is sufficient to provide the intended effect. The exact degree of deviation allowable in some cases may depend on the specific context, e.g., ±1%, ±5%, ±10%, ±15%, etc. It should be understood by those of skill in the art that these terms are intended to allow a description of certain features described and claimed without restricting the scope of these features to the precise numerical ranges provided. Accordingly, these terms should be interpreted as indicating that insubstantial or inconsequential modifications or alterations of the subject matter described are considered to be within the scope of the disclosure.

The term "completion fluid" refers to a liquid used to "complete" a well. The completion fluid is injected into the well to facilitate final operations prior to initiating the production of hydrocarbon fluids. The completion fluid is meant to control a well in case of downhole hardware failure, without damaging the producing formation or the completion components.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" refers to gases, liquids, and combinations of gases and liquids, as well as to combinations of gases and solids, and combinations of liquids and solids.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

A "gas lift system" is a type of artificial lift system used to remove completion fluids from a well or increase the performance of the well. The gas lift system generally to includes a valve system for controlling the injection of compressed, or pressurized, gas from a source external to the well, such as a compressor, into the borehole. The increased pressure from the injected gas forces accumulated formation fluid up the tubing to remove the fluids as production flow or to clear the fluids and restore the free flow of gas from the formation into the well.

A "gas lift valve" is a valve used in a gas lift system to control the flow of lift gas into the production tubing conduit. Operation of the gas lift valve is determined by preset opening and closing pressures in the tubing or annulus, depending on the specific application.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in natural gas, oil, or chemical processing facilities. Moreover, the term "hydrocarbon" may refer to components found in raw natural gas, such as $CH_4$, $C_2H_2$, $C_2H_4$, $C_2H_6$, $C_3$ isomers, $C_4$ isomers, benzene, and the like.

As used herein, a "joint" refers to a single unitary length of pipe. Tubing joints are generally around 30 feet long with a thread connection on each end.

The term "production tubing" refers to a wellbore tubular used to produce hydrocarbon fluids from a reservoir. Production tubing is assembled with other completion components to make up the "production string."

As used herein, the term "tubing collar" refers to a threaded collar used to connect two joints of the production tubing. The type of thread and style of collar varies with the specifications and manufacturer of the tubing.

The terms "well" and "wellbore" refer to holes drilled vertically, at least in part, and may also refer to holes drilled with deviated, highly deviated, and/or horizontal sections. The term also includes wellhead equipment, surface casing, intermediate casing, and the like, typically associated with oil and gas wells.

As used herein, a "well completion" is a group of equipment and operations that may be installed and performed to produce hydrocarbons from a subsurface reservoir. The well completion may include the casing, production tubing, completion fluid, gas lift valves, and other equipment used to prepare the well to produce hydrocarbons.

Overview

The present techniques relate to a self-adjusting gas lift system that utilizes a number of self-adjusting GLVs to assist in the production of hydrocarbon fluids from a well. The self-adjusting GLVs are relatively simple, small-port GLVs. Each self-adjusting GLV opens and closes when the pressure differential within the self-adjusting GLV is in a specifically engineered range. This ensures that the self-adjusting GLVs automatically open and close at appropriate times during the unloading of completion fluid from the well and the production of hydrocarbon fluids from the reservoir. In various embodiments, the self-adjusting gas lift system provides various advantages over conventional gas lift systems, as described further herein.

Conventional Gas Lift System

FIG. 1A is a schematic view of a well 100 including a conventional gas lift system. The well 100 includes a wellhead 102 on top of a well casing 104 that passes through a formation 106. The wellhead 102 includes a coupling 108 for injecting compressed gas 110 into an annulus 112 of the well 100, for example, formed between the well casing 104 and production tubing 114. The compressed gas 110 is typically dehydrated natural gas that is pressurized to about 1,000 to 6,000 pounds per square inch (psi).

The production tubing 114 includes a number of side-pocket mandrels 116A, 116B, and 116C and a production packer 118. Downhole, the production packer 118 forces produced hydrocarbon fluids 120 from the formation 106 to travel up through the production tubing 114. In addition, the production packer 118 keeps the gas flow in the annulus 112 from entering the production tubing 114.

To conduct a conventional gas lift operation, operators install gas lift valves (GLVs) 122A, 122B, and 122C into the side-pocket mandrels 116A, 116B, and 116C, either before deployment or by wireline or slickline after deployment. The GLVs 122A, 122B, and 122C are typically installed anywhere from several hundred to several thousand feet apart. Once the GLVs 122A, 122B, and 122C are installed, the compressed gas 110 is injected into the annulus 112 via the coupling 108. The compressed gas 110 then travels down the annulus 112 until it reaches the side-pocket mandrels 116A, 116B, and 116C. Entering the side-pocket mandrels' ports, the compressed gas 110 passes through the respective GLVs 122A, 122B, and 122C and into the production tubing 114. The GLVs 122A, 122B, and 122C then act as one-way valves by allowing the compressed gas 110 to flow from the annulus 112 to the production tubing 114, while preventing fluid flow in the opposite direction.

Figure 1B:
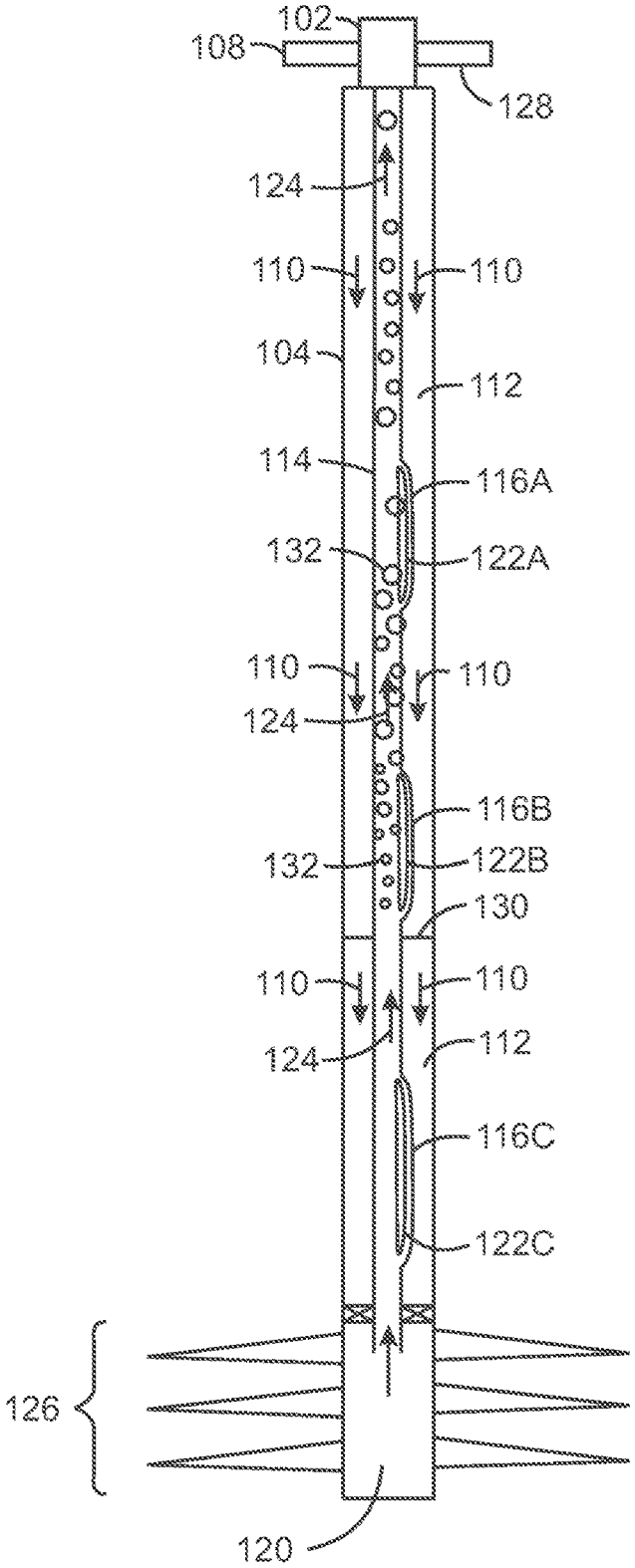
FIG. 1B is a simplified schematic view showing the unloading of completion fluid from the well using the conventional gas lift system.

Once the compressed gas 110 enters the production tubing 114, it rises to the surface, helping to remove completion fluid from the annulus 112 and the production tubing 114, as described further with respect to FIG. 1B. Moreover, once the completion fluid has been removed, the compressed gas 110 is used to help lift the hydrocarbon fluids 120 in the production tubing 114 to the surface when reservoir pressure alone is not sufficient.

FIG. 1B is a simplified schematic view showing the unloading of completion fluid 124 from the well 100 using the conventional gas lift system. Like numbered items are as described with respect to FIG. 1A. Before start-up, the well 100 is filled with the completion fluid 124, in the annulus 112 and the production tubing 114, to provide a pressure cap on the hydrocarbon fluids 120 coming up from a reservoir 126. Once the production tubing 114 is in place, the completion fluid 124 is typically removed, for example, to be replaced with the compressed gas 110 used for gas lift assist.

As shown in FIG. 1B, the unloading of the completion fluid 124 is performed by injecting the compressed gas 110 into the coupling 108 that leads to the annulus 112 of the well 100. As the compressed gas 110 is forced down the annulus 112, the completion fluid 124 is forced through the GLVs 122A, 122B, and 122C, and up the production tubing 114. A production line 128 is coupled to the production tubing 114, and is used to remove the completion fluid 124.

As the liquid level 130 crosses a particular GLV 122A, 122B, and 122C, the compressed gas 110 enters the production tubing 114 through the GLV 122A, 122B, and 122C. The compressed gas 110 creates bubbles 132 that are entrained in the completion fluid 124, which lower the density of the completion fluid 124, allowing the pressure of the compressed gas 110 to push the completion fluid 124 to the surface. As the liquid level 130 crosses a particular GLV 122A, 122B, and 122C, for example, the mid-level GLV 122B, the pressure drop from the compressed gas 110 entering the production tubing 114 through the particular GLV 122B causes a next higher GLV, for example, the highest GLV 122A in the well 100, to close. When the liquid level 130 reaches the lowest GLV 122C, which is the operating valve in the well 100, the pressure drop causes the next higher GLV 122B to close, leaving only the operating valve open. Compressed gas 110 entering through the operating valve may then assist in the production of the hydrocarbon fluids 120 from the reservoir 126.

In some embodiments, the compressed gas 110 includes a gas/liquid mixture. For example, chemicals may also be injected into the annulus 112 to assist in the production of the hydrocarbon fluids 120 from the reservoir 126.

As described with respect to FIG. 1B, ideally, only the operating valve, i.e., the lowest GLV 122C, remain open once the completion fluid 124 has been removed from the annulus 112 and the production tubing 114 via the unloading valves, i.e., the two highest GLVs 122A and 122B. However, in operation, it is difficult to monitor whether a particular GLV 122A, 122B, or 122C is open or closed, or whether multipointing conditions exist within the well 100. Moreover, the well 100 still functions even when it is not optimized. Specifically, the well 100 still flows, albeit at a reduced production rate, even if it is receiving too much (or too little) compressed gas 110 and/or is lifting from multiple GLVs 122A, 122B, and 122C or a GLV 122A or 122B that is shallower than the desired operating point, i.e., an unloading valve instead of the desired operating valve.

Over time, sub-optimal gas lift conditions, such as multipointing, can damage the gas lift system. For example, the GLVs 122A, 122B, and 122C within the gas lift system may be damaged by valve chattering as a result of rapid fluctuations in the pressure of the compressed gas 110 within the annulus 112 of the well 100. Therefore, embodiments described herein provide a self-adjusting gas lift system that avoids the detriments of multipointing by taking advantage of the beneficial aspects of multipointing. Specifically, while the conventional gas lift system described with respect to FIGS. 1A and 1B includes several widely-spaced GLVs, the self-adjusting gas lift system described herein includes a large number of relatively simple, small-port "self-adjusting" GLVs. Each self-adjusting GLV opens and closes when the pressure differential within the self-adjusting GLV is in an engineered range. This ensures that the self-adjusting GLVs open and close at appropriate times during the unloading of the completion fluid 124 and the production of the hydrocarbon fluids 120 from the reservoir 126, as described further with respect to FIGS. 2A and 2B.

Self-Adjusting Gas Lift System

Figure 2A:
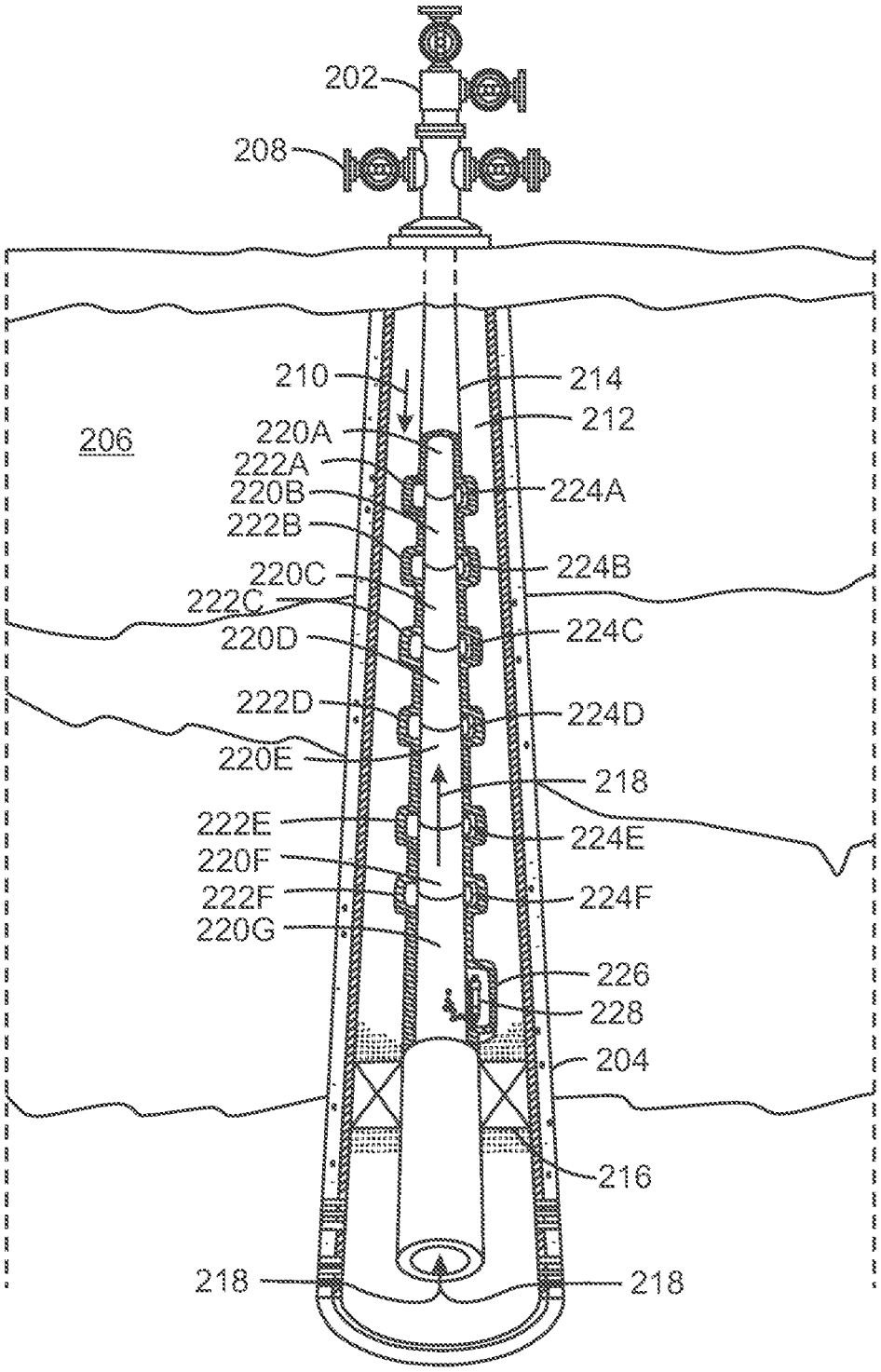
FIG. 2A is a schematic view of a well including a self-adjusting gas lift system.

FIG. 2A is a schematic view of a well 200 including a self-adjusting gas lift system. The well 200 includes a wellhead 202 on top of a well casing 204 that passes through a formation 206. The wellhead 202 includes a coupling 208 for injecting compressed gas 210 into an annulus 212 of the well 200, for example, formed between the well casing 204 and production tubing 214. The compressed gas 210 is typically dehydrated natural gas that is pressurized to about 1,000 to 6,000 pounds per square inch (psi).

The production tubing 214 includes a production packer 216. Downhole, the production packer 216 forces produced hydrocarbon fluids 218 from the formation 206 to travel up through the production tubing 214. In addition, the production packer 216 keeps the gas flow in the annulus 212 from entering the production tubing 214.

The production tubing 214 consists of multiple joints 220A, 220B, 220C, 220D, 220E, 220F and 220G connected by tubing collars 222A, 222B, 222C, 222D, 222E, and 222F. In some embodiments, each joint 220A, 220B, 220C, 220D, 220E, 220F and 220G is to around 30 feet long. According to embodiments described herein, self-adjusting GLVs 224A, 224B, 224C, 224D, 224E, and 224F are installed integral to the tubing collars 222A, 222B, 222C, 222D, 222E, and 222F. The self-adjusting GLVs 224A, 224B, 224C, 224D, 224E, and 224F act as the unloading valves within the self-adjusting gas lift system.

In some embodiments, such as the embodiment shown in FIG. 2A, every tubing collar 222A, 222B, 222C, 222D, 222E, and 222F includes a self-adjusting GLV 224A, 224B, 224C, 224D, 224E, and 224F. In other embodiments, only some of the tubing collars 222A, 222B, 222C, 222D, 222E, and 222F include a self-adjusting GLV 224A, 224B, 224C, 224D, 224E, and 224F. For example, in some cases, a self-adjusting GLV 224A, 224B, 224C, 224D, 224E, and 224F is installed in every other tubing collar 222A, 222B, 222C, 222D, 222E, and 222F, or in every third tubing collar 222A, 222B, 222C, 222D, 222E, and 222F. Moreover, while only seven joints 220A, 220B, 220C, 220D, 220E, 220F and 220G and six tubing collars 222A, 222B, 222C, 222D, 222E, and 222F are shown in FIG. 2A, this is for ease of discussion only, as the production tubing 214 in the well 200 are likely to include a much higher number of joints and tubing collars. Furthermore, while only six self-adjusting GLVs 224A, 224B, 224C, 224D, 224E, and 224F are shown in FIG. 2A, it is to be understood that the self-adjusting gas lift system may include a larger number of self-adjusting GLVs, such as, for example, about 10-20 self-adjusting GLVs, or more, depending on the desired injection depth.

In various embodiments, the production tubing 214 also includes a side-pocket mandrel 226 at the desired operating point. An operating valve 228 is installed into the side-pocket mandrel 226. In some embodiments, the operating valve 228 is an orifice valve, such as a single-point-injection gas lift orifice valve. In other embodiments, the operating valve 228 is a typical gas lift valve, such as an injection-pressure-operated (IPO) valve or a production-pressure-operated (PPO) valve.

Once the self-adjusting GLVs 224A, 224B, 224C, 224D, 224E, and 224F and the operating valve 228 are installed, the compressed gas 210 is injected into the annulus 212 via the coupling 208. The compressed gas 210 then travels down the annulus 212 until it reaches the self-adjusting GLVs 224A, 224B, 224C, 224D, 224E, and 224F. When each self-adjusting GLV 224A, 224B, 224C, 224D, 224E, and 224F is in the open position, the compressed gas 210 passes through the respective self-adjusting GLV 224A, 224B, 224C, 224D, 224E, and 224F and into the production tubing 214. The self-adjusting GLVs 224A, 224B, 224C, 224D, 224E, and 224F then act as one-way valves by allowing the compressed gas 210 to flow from the annulus 212 to the production tubing 214, while preventing fluid flow in the opposite direction.

Figure 2B:
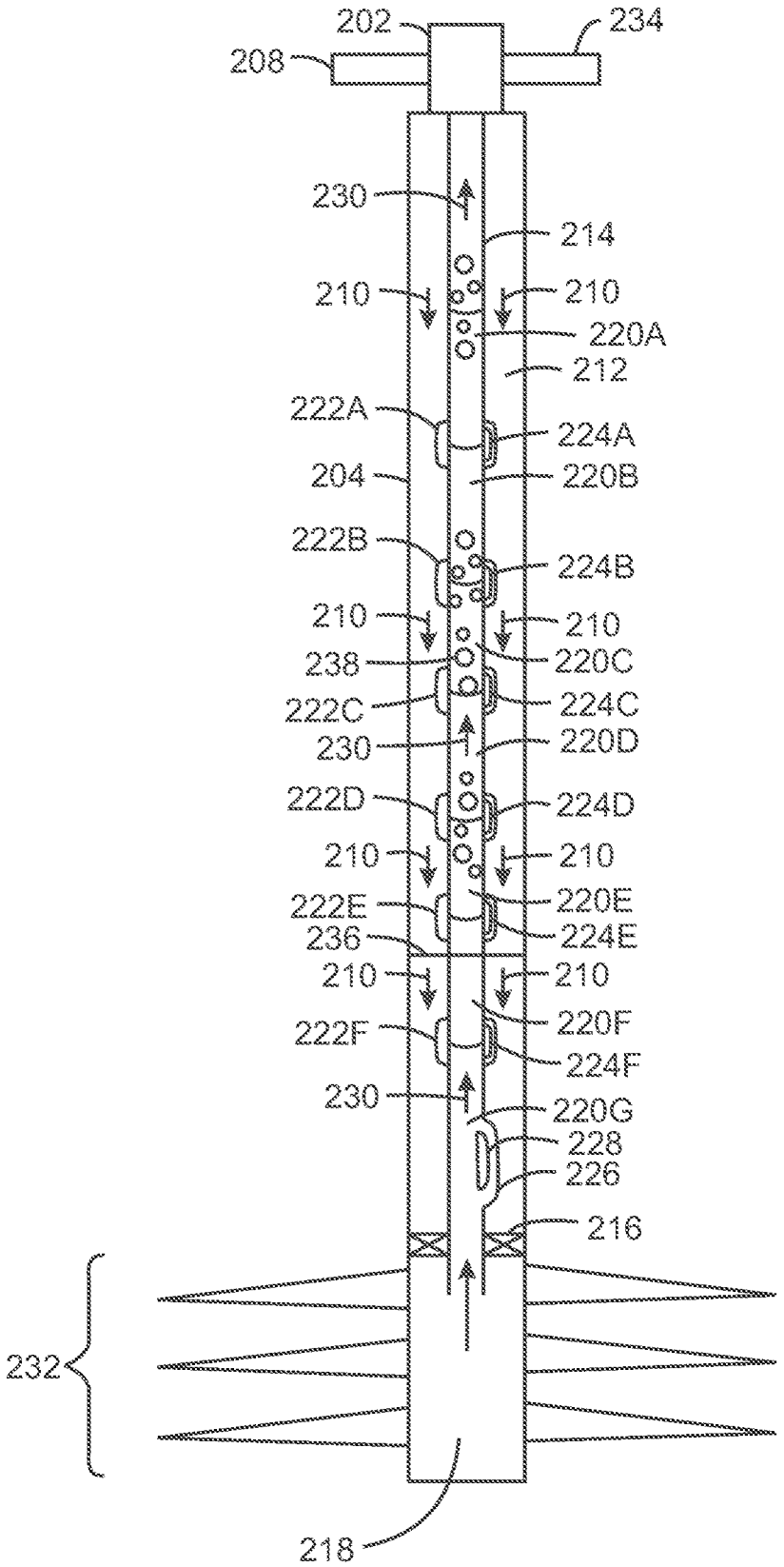
FIG. 2B is a simplified schematic view showing the unloading of completion fluid from the well using the self-adjusting gas lift system.

Once the compressed gas 210 enters the production tubing 214, it rises to the surface, helping to remove completion fluid from the annulus 212 and the production tubing 214, as described further with respect to FIG. 2B. Moreover, once the completion fluid has been removed, the operating valve 228 is typically the only valve still open. The compressed gas 210 flowing through the operative valve 228 then helps to lift the hydrocarbon fluids 218 in the production tubing 214 to the surface when reservoir pressure alone is not sufficient.

FIG. 2B is a simplified schematic view showing the unloading of completion fluid 230 from the well 200 using the self-adjusting gas lift system. Before start-up, the well 200 is filled with the completion fluid 230, in the annulus 212 and the production tubing 214, to provide a pressure cap on the hydrocarbon fluids 218 coming up from a reservoir 232. Once the production tubing 214 is in place, the completion fluid 230 is typically removed, for example, to be replaced with the compressed gas 210 used for gas lift assist.

The unloading of the completion fluid 230 is performed by injecting the compressed gas 210 into the coupling 208 that leads to the annulus 212 of the well 200. As the compressed gas 210 is forced down the annulus 212, the completion fluid 230 is forced through the self-adjusting GLVs 224A, 224B, 224C, 224D, 224E, and 224F, and up the production tubing 214. A production line 234 is coupled to the production tubing 214, and is used to remove the completion fluid 230.

According to embodiments described herein, the self-adjusting GLVs 224A, 224B, 224C, 224D, 224E, and 224F are simple, relatively small-port valves. Each self-adjusting GLV 224A, 224B, 224C, 224D, 224E, and 224F includes a differential valve, an injection port, and a reverse-flow check valve, as described further with respect to FIGS. 3 and 4A-D. Each self-adjusting GLV's differential valve only opens when the pressure differential acting upon the differential valve is within an engineered range. More particularly, each self-adjusting GLV's differential valve opens when the pressure differential between the injection pressure of the compressed gas 210 within the annulus 212 and the production pressure of the fluids, such as the hydrocarbon fluids 218 and/or the completion fluid 230, within the production tubing 214 is within an engineered range.

In various embodiments, the engineered range may include a range of about 100-200 psi. For example, a particular self-adjusting GLV may be engineered to open when the pressure differential is between 150-250 psi. If the pressure differential is below the lower threshold of 150 psi or above the upper threshold of 250 psi, the self-adjusting GLV remain closed.

In various embodiments, the self-adjusting GLVs 224A, 224B, 224C, 224D, 224E, and 224F may be placed in the self-adjusting gas lift system such that the range of pressure differentials for which each self-adjusting GLV 224A, 224B, 224C, 224D, 224E, and 224F opens gradually increases with well depth. Moreover, in some embodiments, two or more consecutive self-adjusting GLVs 224A, 224B, 224C, 224D, 224E, and 224F may be engineered to open when the pressure differential is in the same range, or when the pressure differential is in partially-overlapping ranges. Therefore, in some cases, two or more consecutive self-adjusting GLVs 224A, 224B, 224C, 224D, 224E, and 224F may be open simultaneously.

In operation, as the liquid level 236 of the completion fluid 230 crosses a particular self-adjusting GLV 224A, 224B, 224C, 224D, 224E, and 224F, the pressure differential may be in the correct range to open the self-adjusting GLV 224A, 224B, 224C, 224D, 224E, and 224F. When the self-adjusting GLV 224A, 224B, 224C, 224D, 224E, and 224F is in the open position, the compressed gas 210 enters the production tubing 214 through the self-adjusting GLV 224A, 224B, 224C, 224D, 224E, and 224F, creating bubbles 238 that are entrained in the completion fluid 230. This lowers the density of the completion fluid 230 and the hydrostatic pressure within the production tubing 214, allowing the pressure of the compressed gas 210 to push the completion fluid 230 to the surface.

In various embodiments, because the self-adjusting GLVs 224A, 224B, 224C, 224D, 224E, and 224F are designed to open and close when the pressure differential is in specific ranges, the active gas lift injection points automatically move further down the well 200 as the injection pressure is increased. Therefore, as the liquid level 236 moves further down the well 200, higher self-adjusting GLVs, such as the self-adjusting GLVs 224A, 224B, 224C and 224D, close, while lower self-adjusting GLVs, such as self-adjusting GLVs 224E and 224F, open. When the liquid level 236 reaches the operating valve 228, all self-adjusting GLVs 224A, 224B, 224C, 224D, 224E, and 224F are typically closed. The operating valve 228 may then be used to assist in the production of the hydrocarbon fluids 218 from the reservoir 232. In some embodiments, a standard orifice valve is installed as the operating valve 228 to provide pressure relief in case the injection pressure becomes too high.

Moreover, in some embodiments, the injection pressure is held constant at the surface, while the production pressure varies intermittently depending on the reservoir inflow and the well's personality. Specifically, if production is stable, then the production pressure within the production tubing 214 may be stable, and the injection points may not change. However, if the well 200 starts to slug, creating cyclical pressure profiles, the injection points may self-adjust, e.g., the self-adjusting GLVs 224E and 224F automatically open and close at appropriate times. This automatically reduces the disruptive effect of the slugging to the downhole and surface components.

Furthermore, in some embodiments, because the self-adjusting GLVs 224A, 224B, 224C, 224D, 224E, and 224F are designed to open and close when the pressure differential is in specific ranges, the active gas lift injection points automatically move further down the well 200 as the production pressure decreases. This is particularly useful for unconventional wells, which tend to rapidly decline in pressure. In such embodiments, the injection pressure may typically be held constant, and the self-adjusting gas lift system may allow for automatic optimization of the well 200 as the pressure drops without requiring any additional optimization procedures other than possibly changing the injection gas ratio to compensate for lower liquid volumes.

The self-adjusting gas lift system described herein provides several advantages over a conventional gas lift system. Specifically, the self-adjusting GLVs 224A, 224B, 224C, 224D, 224E, and 224F are small enough that they can be installed integral to the tubing collars 222A, 222B, 222C, 222D, 222E, and 222F, as described further with respect to FIG. 3. This allows a large number of self-adjusting GLVs 224A, 224B, 224C, 224D, 224E, and 224F to be used within the self-adjusting gas lift system. This redundancy creates bypass injection paths in case of valve plugging and/or malfunctioning within the self-adjusting gas lift system. Moreover, in some embodiments, a pair of reverse-flow checks may be used in each self-adjusting GLV 224A, 224B, 224C, 224D, 224E, and 224F to increase backflow reliability.

In addition, several self-adjusting GLVs 224A, 224B, 224C, 224D, 224E, and 224F may be open simultaneously within the self-adjusting gas lift system. However, this does not result in typical multipointing issues because the injection points are tightly clustered together due to the relatively small ranges of pressure differentials for which the self-adjusting GLVs 224A, 224B, 224C, 224D, 224E, and 224F are open.

Furthermore, contrary to a conventional gas lift system, the injection pressure within the self-adjusting gas lift system may not decrease during the unloading process since the self-adjusting GLVs 224A, 224B, 224C, 224D, 224E, and 224F do not act as pressure regulators like typical GLVs, such as the GLVs 122A, 122B, and 122C described with respect to FIGS. 1A and 1B. As a result, all of the available surface injection pressure may be used for downhole injection at the maximum possible depth.

The schematic views of FIGS. 2A and 2B are not intended to indicate that the self-adjusting gas lift system is to include all of the components shown in FIGS. 2A and 2B. Moreover, any number of additional components may be included within the self-adjusting gas lift system, depending on the details of the specific implementation. Moreover, while the self-adjusting GLVs 224A, 224B, 224C, 224D, 224E, and 224F are shown as being integrated into the tubing collars 222A, 222B, 222C, 222D, 222E, and 222F within the well 200, it is to be understood that the self-adjusting GLVs 224A, 224B, 224C, 224D, 224E, and 224F may also be installed into the well 200 in any other suitable fashion. For example, in some embodiments, the self-adjusting GLVs 224A, 224B, 224C, 224D, 224E, and 224F may be installed integral to the joints 220A, 220B, 220C, 220D, 220E, 220F and 220G of the production tubing 214. In other embodiments, the self-adjusting GLVs 224A, 224B, 224C, 224D, 224E, and 224F may be installed within typical side-pocket mandrels or conventional mandrels, or within any other suitable mounting points.

Furthermore, while the well 200 shown in FIGS. 2A and 2B is a vertical well, it is to be understood that any other type of well may also be used according to embodiments described herein. For example, in some embodiments, the well 200 may include deviated, highly deviated, and/or horizontal sections.

In some embodiments, the self-adjusting gas lift system within the well 200 is modified such that the self-adjusting GLVs 224A, 224B, 224C, 224D, 224E, and 224F allow for the injection of the compressed gas 210 from the production tubing 214 into the annulus 212. This configuration of the self-adjusting gas lift system may be useful for unconventional wells, for example, to maximize production via the larger cross-sectional area of the annulus 212 during the first few months of operation. In such embodiments, the production tubing 214 may subsequently be pulled to adjust the configuration of the self-adjusting GLVs 224A, 224B, 224C, 224D, 224E, and 224F for normal operation.

Self-Adjusting Gas Lift Valve

Figure 3:
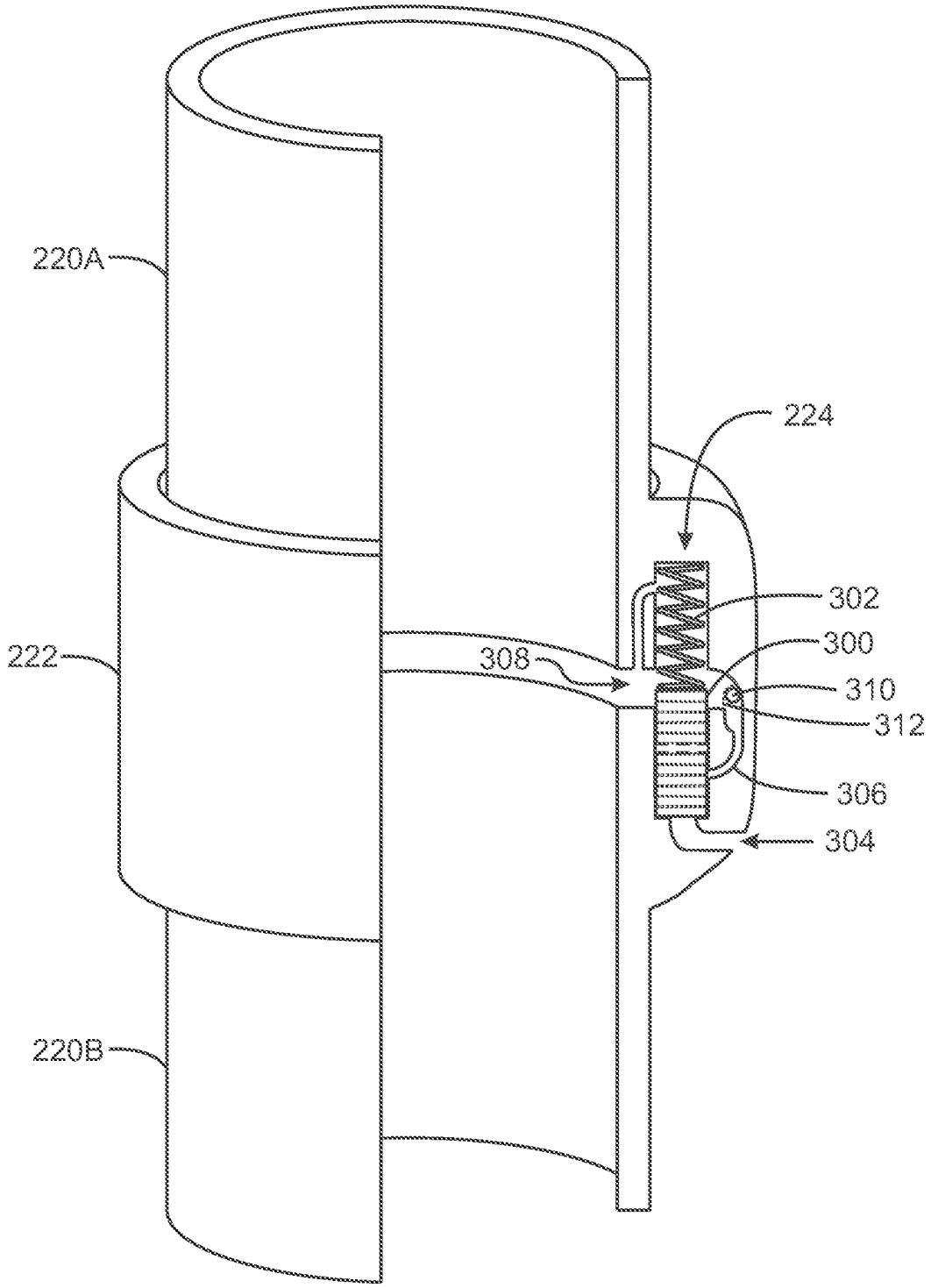
FIG. 3 is a cross-sectional view of a section of the production tubing showing an exemplary embodiment of the self-adjusting GLV disposed within the tubing collar.

FIG. 3 is a cross-sectional view of a section of the production tubing 214 showing an exemplary embodiment of the self-adjusting GLV 224 disposed within the tubing collar 222. Like numbered items are as described with respect to FIGS. 2A and 2B. As shown in FIG. 3, the tubing collar 222 connects two joints 220A and 220B of the production tubing 214 together. Moreover, the self-adjusting GLV 224 is installed integral to the tubing collar 222 such that the self-adjusting GLV 224 fluidically couples the annulus 212 of the well 200 to the interior of the production tubing 214.

The self-adjusting GLV 224 includes three main components: a differential valve, an injection port, and a reverse-flow check valve. According to the embodiment shown in FIG. 3, the differential valve includes a plug 300 and a spring 302. The injection port of the self-adjusting GLV 224 includes a gas inlet 304, a U-shaped flow path 306, and a gas outlet 308. In addition, the reverse-flow check valve includes a ball 310 and a mesh restrainer 312. These components are described in more detail with respect to FIGS. 4A-D.

Figure 4A:
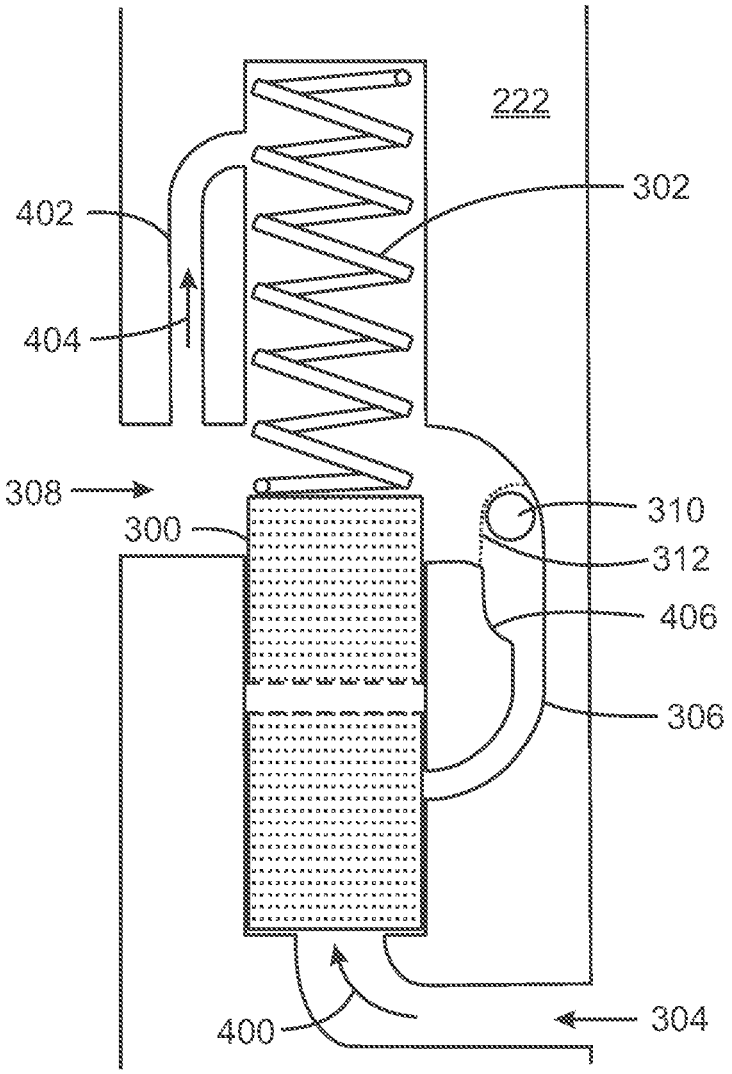
FIG. 4A is a schematic view showing the exemplary embodiment of the self-adjusting GLV in the first closed position when the pressure differential is below a lower threshold.

FIG. 4A is a schematic view showing an exemplary embodiment of the self-adjusting GLV 224 in the first closed position when the pressure differential is below a lower threshold. Like numbered items are as described with respect to FIGS. 2A, 2B and 3. In various embodiments, the self-adjusting GLV 224 resides within the tubing collar 222, as described with respect to FIG. 3. The self-adjusting GLV 224 is configured to move from the closed position to the open position when the pressure differential between the injection pressure of the compressed gas 210 within the annulus 212 and the production pressure of the fluids, such as the hydrocarbon fluids 218 and/or the completion fluid 230, within the production tubing 214 is within an engineered range. When the pressure differential is outside the engineered range, the self-adjusting GLV 224 is in the closed position. Specifically, the self-adjusting GLV 224 is in a first closed position when the pressure differential is below the lower end of the range, as shown in FIG. 4A. In addition, the self-adjusting GLV 224 is in a second closed position when the pressure differential is above the upper end of the range, as shown in FIG. 4D.

In various embodiments, the gas inlet 304, the U-shaped flow path 306, and the gas outlet 308 fluidically couple the annulus 212 of the well 200 to the interior of the production tubing 214. Specifically, the compressed gas 210 within the annulus 212 flows into the self-adjusting GLV 224 via the gas inlet 304. The compressed gas 210 then flows through the self-adjusting GLV 224 and into the production tubing 214 via the gas outlet 308 when the self-adjusting GLV 224 is in the open position, as described with respect to FIG. 4B.

During normal operation, the compressed gas 210 flowing into the self-adjusting GLV 224 via the gas inlet 304 exerts pressure on the plug 300. This pressure is referred to herein as the "injection pressure," and is indicated by arrow 400 in FIG. 4A. In addition, fluids flowing backwards into the self-adjusting GLV 224 via the gas outlet 308 enter a production fluid flow path 402 and exert pressure on the spring 302. This pressure is referred to herein as the "production pressure," and is indicated by arrow 404. The difference between the injection pressure and the production pressure is referred to as the "pressure differential." The pressure differential controls the opening and closing of the self-adjusting GLV 224. Specifically, when the pressure differential is below the engineered range, i.e., below the lower threshold, the injection pressure within the gas inlet 304 does not exert enough force on the plug 300 to overcome the production pressure acting upon the spring 302. Therefore, the spring 302 does not compress, and the plug 300 remains in place, preventing the compressed gas 210 within the gas inlet 304 from entering the U-shaped flow path 306. Furthermore, if the fluids within the production tubing 214 enter the self-adjusting GLV 224 via the gas outlet 308, the ball 310 may be pushed into its seat 406, preventing the fluids from entering the U-shaped flow path 306. As a result, fluids may not flow through the self-adjusting GLV 224 in either direction when the self-adjusting GLV 224 is in the first closed position.

Figure 4B:
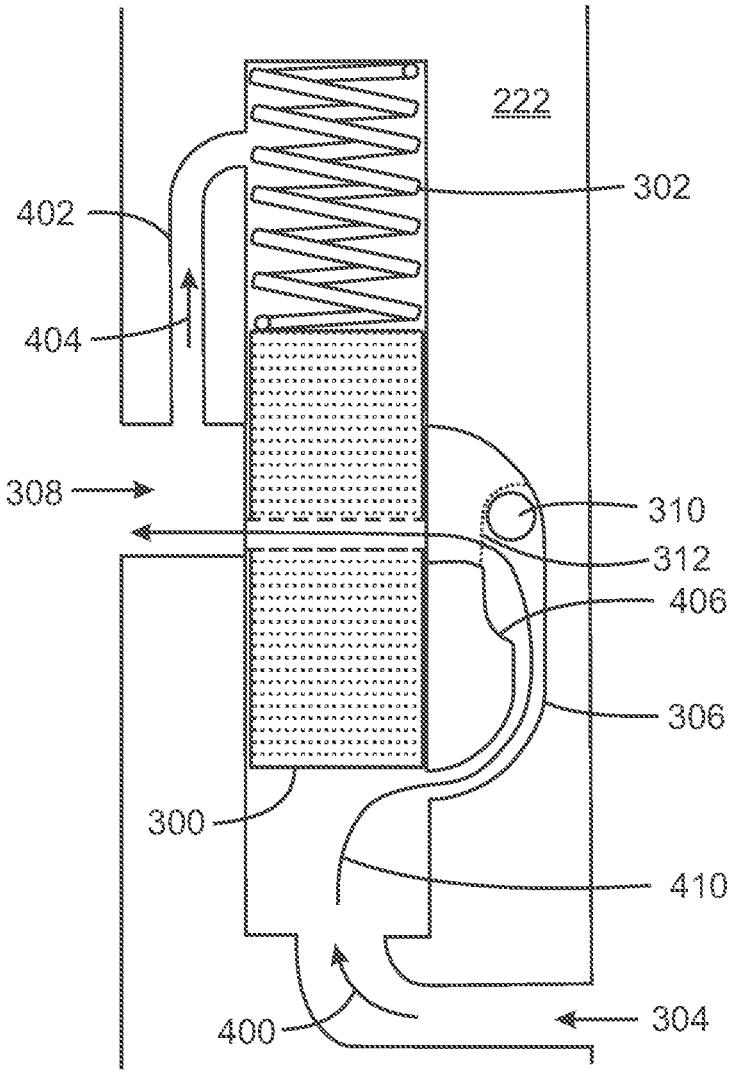
FIG. 4B is a schematic view showing the exemplary embodiment of the self-adjusting GLV in the open position.
Figure 4C:
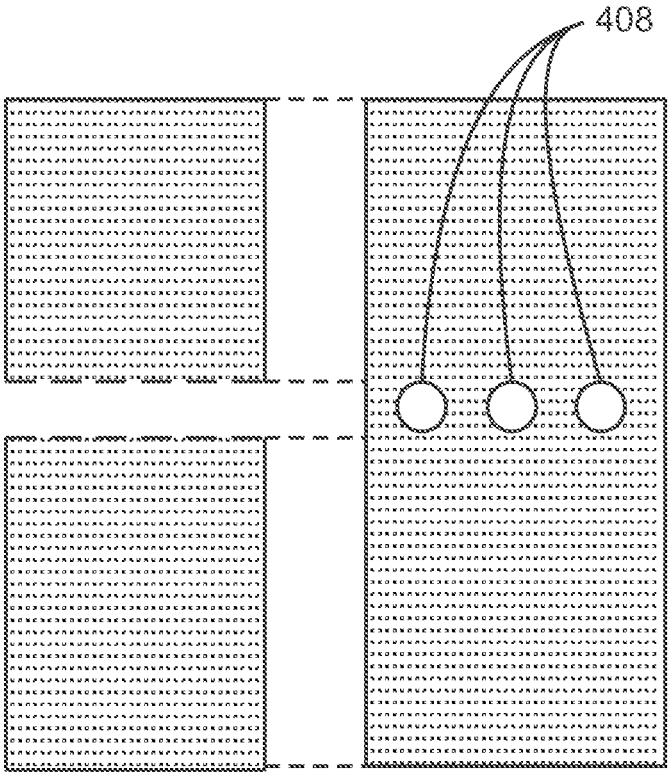
FIG. 4C is cross-sectional side view of the plug of the self-adjusting GLV.
Figure 4D:
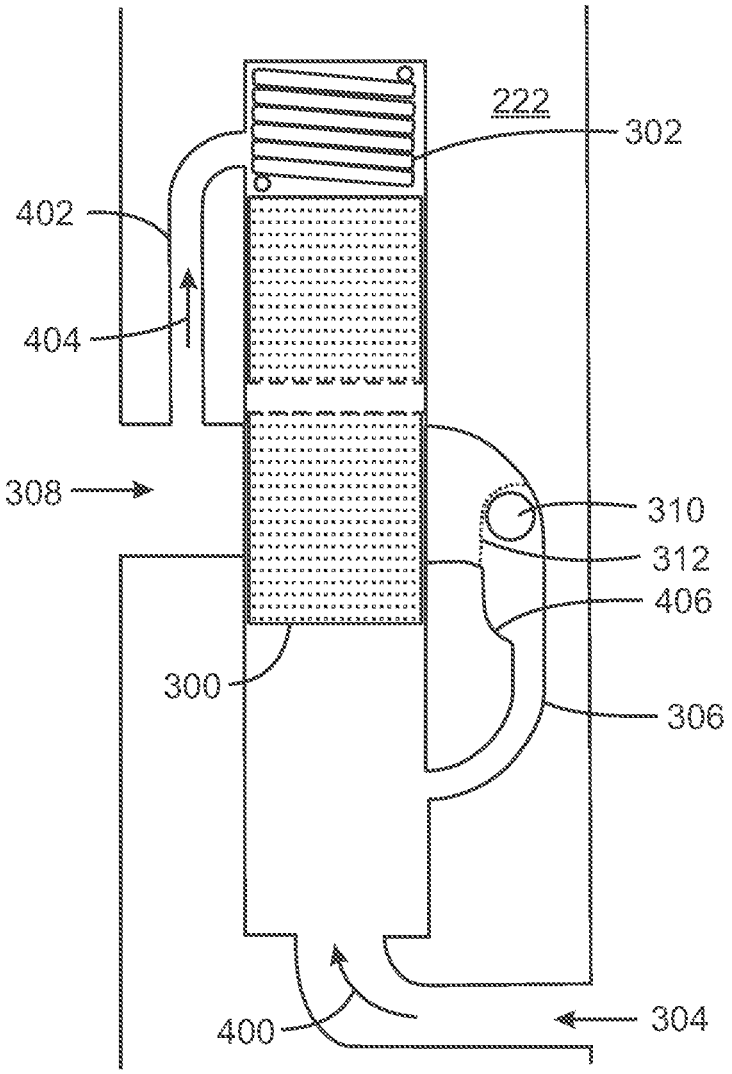
FIG. 4D is a schematic view showing an exemplary embodiment of the self-adjusting GLV in the second closed position when the pressure differential is above the upper threshold.

FIG. 4B is a schematic view showing the exemplary embodiment of the self-adjusting GLV 224 in the open position. FIG. 4C is cross-sectional side view of the plug 300 of the self-adjusting GLV 224. Like numbered items are as described with respect to FIGS. 2A, 2B, 3, and 4A. As shown in FIG. 4C, the plug 300 includes a number of passages or holes 408 that allow for gas passage when the self-adjusting GLV 224 is in the open position, as shown in FIG. 4B. Specifically, when the pressure differential is within the engineered range for the self-adjusting GLV 224, the injection pressure exerts enough force on the plug 300 to partially overcome the production pressure acting upon the spring 302. As a result, the spring 302 is partially compressed, and the plug 300 moves such that the holes 408 align with the U-shaped flow path 306. This allows the compressed gas 210 to flow through the self-adjusting GLV 224, as indicated by arrow 410, and into the interior of the production tubing 214.

FIG. 4D is a schematic view showing an exemplary embodiment of the self-adjusting GLV 224 in the second closed position when the pressure differential is above the upper threshold. Like numbered items are as described with respect to FIGS. 2A, 2B, 3 and 4A-C. As shown in FIG. 4D, when the pressure differential is above the engineered range, i.e., above the upper threshold, the injection pressure exerts enough force to entirely overcome the production pressure acting upon the spring 302. As a result, the spring 302 is fully compressed, and the holes 408 of the plug 300 move past the U-shaped flow path 306. This prevents the compressed gas within the gas inlet 304 from flowing through the self-adjusting GLV 224 via the U-shaped flow path 306. Moreover, the plug 300 entirely blocks the gas outlet 308, thus preventing the fluids within the production tubing 214 from entering the U-shaped flow path 306. As a result, fluids do not flow through the self-adjusting GLV 224 in either direction when the self-adjusting GLV 224 is in the second closed position.

The cross-sectional view of FIG. 3 and the schematic views of FIGS. 4A-D are not intended to indicate that the self-adjusting GLV 224 is to include all of the components shown in FIGS. 3 and 4A-D. Moreover, any number of additional components may be included within the self-adjusting GLV 224, depending on the details of the specific implementation. Furthermore, it is to be understood that the self-adjusting GLV 224 shown in FIGS. 3 and 4A-D is merely one exemplary embodiment of the self-adjusting GLV described herein. The specific components of the self-adjusting GLV 224 described with respect to FIGS. 3 and 4A-D may be replaced with any other suitable components that perform the same, or similar, functions. For example, the plug 300 and the spring 302 may be replaced with any suitable type of differential valve; the gas inlet 304, the U-shaped flow path 306, and the gas outlet may be replaced with any suitable type of injection port; and the ball 310 and the mesh restrainer 312 may be replaced with any suitable type of reverse-flow check valve.

In some embodiments, the self-adjusting GLV 224 includes a high-pressure-differential shear relief valve. The shear relief valve may permanently open the self-adjusting GLV 224 to provide additional pressure relief when the pressure differential becomes too high.

Figure 5:
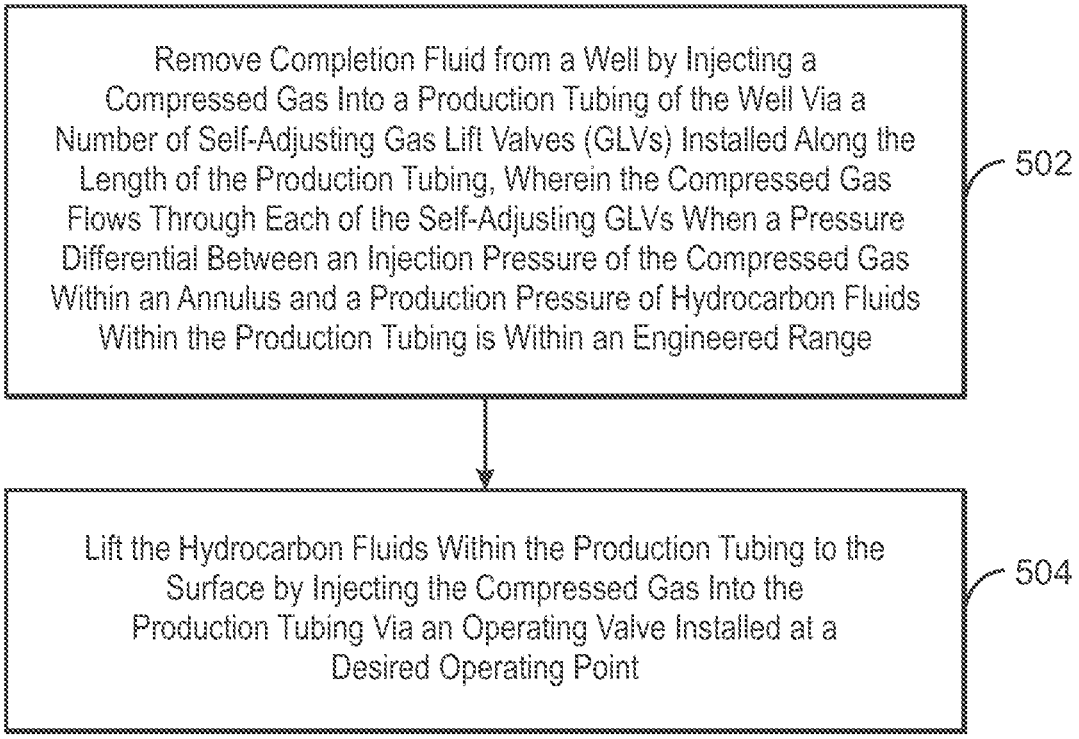
FIG. 5 is a process flow diagram of a method for lifting hydrocarbon fluids from a well using a self-adjusting gas lift system.

Method for Lifting Hydrocarbon Fluids from a Well Using a Self-Adjusting Gas Lift System FIG. 5 is a process flow diagram of a method 500 for lifting hydrocarbon fluids from a well using a self-adjusting gas lift system. The method 500 is implemented by a self-adjusting gas lift system, such as the self-adjusting gas lift system described with respect to FIGS. 2A and 2B. The self-adjusting gas lift system includes a number of self-adjusting gas lift valves (GLVs), such as the self-adjusting GLVs 224A, 224B, 224C, 224D, 224E, and 224F described with respect to FIGS. 2A, 2B, 3, and 4A-D.

The method 500 begins at block 502, at which completion fluid is removed from a well by injecting a compressed gas into a production tubing of the well via a number of self-adjusting GLVs installed along the length of the production tubing. The compressed gas flows through each of the self-adjusting GLVs when a pressure differential between an injection pressure of the compressed gas within an annulus and a production pressure of hydrocarbon fluids within the production tubing is within an engineered range.

According to embodiments described herein, each self-adjusting GLV includes a differential valve, an injection port, and a reverse-flow check valve. In some embodiments, the differential valve includes a plug and a spring; the injection port includes a gas inlet, a U-shaped flow path, and a gas outlet; and the reverse-flow check valve includes a ball and a mesh restrainer. In such embodiments, the injection pressure is applied to the plug via the compressed gas entering the gas inlet, and the production pressure is applied to the spring via the hydrocarbon fluids entering a production fluid flow path within the gas outlet. Moreover, in some embodiments, each self-adjusting GLV is installed integral to a respective tubing collar of the production tubing.

Because the engineered ranges of pressure differentials for which successive self-adjusting GLVs open are tightly clustered together, the method 500 may include simultaneously using multiple self-adjusting GLVs to inject the compressed gas into the production tubing. Furthermore, the method 500 may include automatically adjusting which of the self-adjusting GLVs are being used to inject the compressed gas into the production tubing as the pressure differential fluctuates.

At block 504, the hydrocarbon fluids within the production tubing are lifted to the surface by injecting the compressed gas into the production tubing via an operating valve installed at a desired operating point. In some embodiments, the operating valve is an orifice valve that also provides pressure relief in case the injection pressure within the annulus of the well becomes too high.

The process flow diagram of FIG. 5 is not intended to indicate that the steps of the method 500 are to be executed in any particular order, or that all of the steps of the method 500 are to be included in every case. Further, any number of additional steps not shown in FIG. 5 may be included within the method 500, depending on the details of the specific implementation. For example, in some embodiments, the method 500 includes initially configuring the self-adjusting gas lift system such that the self-adjusting GLVs inject the compressed gas from the production tubing into the annulus, and subsequently reconfiguring the self-adjusting gas lift system such that the self-adjusting GLVs inject the compressed gas from the annulus into the production tubing during normal operation.

As may be appreciated, the present techniques may be susceptible to various modifications and alternative forms, the examples discussed above have been shown only by way of example. For example, the self-adjusting gas lift valves (GLVs) may be fluidically couple an annulus of a well to an interior of a production tubing of the well, and each of the self-adjusting GLVs may be configured to: open to allow a compressed gas to flow from the annulus to the interior of the production tubing when a pressure differential between an injection pressure of the compressed gas within the annulus and a production pressure of fluids within the production tubing is within an engineered range; and close when the pressure differential is outside the engineered range. The flow of fluids may be adjusted to flow in either direction, which may depend upon the configuration of the system. Further, the pressure differential may be a predefined range. That is, the predefined range may not depend on the dome pressure within the valve, but may be based on a comparison of the external pressure within the wellbore and the injection pressure.

In other embodiments, other variations may be utilized to enhance the present techniques. For example, two or more of the self-adjusting GLVs may be configured to simultaneously open to inject the compressed gas into the production tubing. That is, the self-adjusting GLVs may be installed in a closer configuration than conventional systems. In one embodiment, the self-adjusting GLVs may be installed at each tubing joint to lift through multiple self-adjusting GLVs at once. Typical systems utilize less than ten or fifteen valves and are spaced further apart, while the present techniques may be utilized on each collar for certain segments or between segments. Further, other embodiments may include one or more sensors within the wells, while others may not utilizes sensors with the self-adjusting GLVs. That is, an electromechanical sensor with a mechanism may be used to control or communicate with the self-adjusting GLVs or it may rely upon a change the differential setting on respective self-adjusting GLVs. In some embodiments, the pressures may be modified to change the injection location, which may use sensor data from the wellbore to determine whether to make such adjustments in the operations.

In yet other embodiments, a self-adjusting gas lift valve (GLV) may include various components disposed within a housing or body. The self-adjusting GLV may each include an injection port; a differential valve configured to: allow a compressed gas to flow through the injection port when a pressure differential acting upon the differential valve is within an engineered range; and prevent the compressed gas from flowing through the injection port when the pressure differential acting upon the differential valve is outside the engineered range; and a reverse-flow check valve configured to prevent fluids from flowing backwards through the injection port. The self-adjusting gas lift valve GLV may be a separate component attached to the production tubing or collar or may be an integral part of the production tubing or collar.

Indeed, the present techniques include various embodiment, as noted below in the following paragraphs 1 to 37, which are noted below:

1. A self-adjusting gas lift system, comprising a plurality of self-adjusting gas lift valves (GLVs) that fluidically couple an annulus of a well to an interior of a production tubing of the well, wherein each of the plurality of self-adjusting GLVs is configured to: open to allow a compressed gas to flow from the annulus to the interior of the production tubing when a pressure differential between an injection pressure of the compressed gas within the annulus and a production pressure of fluids within the production tubing is within an engineered range; and close when the pressure differential is outside the engineered range.

2. The self-adjusting gas lift system of paragraph 1, wherein each of the plurality of self-adjusting GLVs is configured to close when the pressure differential is outside the engineered range by: moving to a first closed position when the pressure differential is below the engineered range; and moving to a second closed position when the pressure differential is above the engineered range.

3. The self-adjusting gas lift system of paragraph 1 or 2, wherein more than one of the plurality of self-adjusting GLVs are open simultaneously.

4. The self-adjusting gas lift system of paragraph 3, wherein the self-adjusting gas lift system is configured to automatically adjust which of the plurality of self-adjusting GLVs are open as the pressure differential fluctuates.

5. The self-adjusting gas lift system of any of paragraphs 1 to 4, wherein each of the plurality of self-adjusting GLVs comprises: a differential valve; an injection port; and a reverse-flow check valve.

6. The self-adjusting gas lift system of paragraph 5, wherein the differential valve comprise a plug and a spring.

7. The self-adjusting gas lift system of paragraph 5, wherein the injection port comprises a gas inlet, a U-shaped flow path, and a gas outlet.

8. The self-adjusting gas lift system of paragraph 5, wherein the reverse-flow check valve comprises a ball and a mesh restrainer.

9. The self-adjusting gas lift system of any of paragraphs 1 to 8, wherein each of the plurality of self-adjusting GLVs is installed integral to a respective tubing collar of the production tubing.

10. The self-adjusting gas lift system of any of paragraphs 1 to 9, comprising an operating valve at a desired operating point within the well.

11. The self-adjusting gas lift system of paragraph 10, wherein the operating valve comprises an orifice valve.

12. The self-adjusting gas lift system of any of paragraphs 1 to 11, wherein the self-adjusting gas lift system is initially configured such that the plurality of self-adjusting GLVs allow the compressed gas to flow from the production tubing to the annulus.

13. The self-adjusting gas lift system of paragraph 12, wherein the self-adjusting gas lift system is subsequently reconfigured such that the plurality of self-adjusting GLVs allow the compressed gas to flow from the annulus to the production tubing during normal operation.

14. A method for lifting hydrocarbon fluids from a well using a self-adjusting gas lift system, comprising: removing completion fluid from a well by injecting a compressed gas into a production tubing of the well via a plurality of self-adjusting gas lift valves (GLVs) installed along a length of the production tubing, wherein the compressed gas flows through each of the plurality of self-adjusting GLVs when a pressure differential between an injection pressure of the compressed gas within an annulus and a production pressure of hydrocarbon fluids within the production tubing is within an engineered range; and lifting the hydrocarbon fluids within the production tubing to a surface by injecting the compressed gas into the production tubing via an operating valve installed at a desired operating point.

15. The method of paragraph 14, wherein each of the plurality of self-adjusting GLVs comprises: a differential valve; an injection port; and a reverse-flow check valve.

16. The method of paragraph 15, wherein the differential valve comprise a plug and a spring; the injection port comprises a gas inlet, a U-shaped flow path, and a gas outlet; and the reverse-flow check valve comprises a ball and a mesh restrainer.

17. The method of paragraph 16, wherein the injection pressure is applied to the plug via the compressed gas entering the gas inlet, and the production pressure is applied to the spring via the hydrocarbon fluids entering a production fluid flow path within the gas outlet.

18. The method of any of paragraphs 14 to 17, wherein each of the plurality of self-adjusting GLVs is installed integral to a respective tubing collar of the production tubing.

19. The method of any of paragraphs 14 to 18, wherein the operating valve comprises an orifice valve.

20. The method of any of paragraphs 14 to 19, comprising simultaneously using more than one of the plurality of self-adjusting GLVs to inject the compressed gas into the production tubing.

21. The method of paragraph 20, comprising automatically adjusting which of the plurality of self-adjusting GLVs are being used to inject the compressed gas into the production tubing as the pressure differential fluctuates.

22. The method of any of paragraphs 14 to 21, comprising: initially configuring the self-adjusting gas lift system such that the plurality of self-adjusting GLVs inject the compressed gas from the production tubing into the annulus; and subsequently reconfiguring the self-adjusting gas lift system such that the plurality of self-adjusting GLVs inject the compressed gas from the annulus into the production tubing during normal operation.

23. A well completion, comprising a plurality of self-adjusting gas lift valves (GLVs) that fluidically couple an annulus of a well to an interior of a production tubing of the well, wherein the plurality of self-adjusting GLVs are configured to optimize a production of hydrocarbon fluids from the well by automatically opening and closing based on a pressure differential between an injection pressure of a compressed gas within the annulus and a production pressure of the hydrocarbon fluids within the production tubing.

24. The well completion of paragraph 23, wherein each of the plurality of self-adjusting GLVs is configured to: move to a first closed position when the pressure differential is below an engineered range; move to an open position when the pressure differential is within the engineered range; and move to a second closed position when the pressure differential is above the engineered range.

25. The well completion of paragraph 23 or 24, wherein more than one of the plurality of self-adjusting GLVs are open simultaneously.

26. The well completion of any of paragraphs 23 to 25, wherein each of the plurality of self-adjusting GLVs comprises: a differential valve; an injection port; and a reverse-flow check valve.

27. The well completion of paragraph 26, wherein the differential valve comprise a plug and a spring; the injection port comprises a gas inlet, a U-shaped flow path, and a gas outlet; and the reverse-flow check valve comprises a ball and a mesh restrainer.

28. The well completion of any of paragraphs 23 to 27, wherein each of the plurality of self-adjusting GLVs is installed integral to a respective tubing collar of the production tubing.

29. The well completion of any of paragraphs 23 to 28, comprising an operating valve at a desired operating point within the well.

30. A self-adjusting gas lift valve (GLV), comprising: an injection port; a differential valve configured to: allow a compressed gas to flow through the injection port when a pressure differential acting upon the differential valve is within an engineered range; and prevent the compressed gas from flowing through the injection port when the pressure differential acting upon the differential valve is outside the engineered range; and a reverse-flow check valve configured to prevent fluids from flowing backwards through the injection port.

31. The self-adjusting GLV of paragraph 30, wherein the differential valve comprise a plug and a spring.

32. The self-adjusting GLV of paragraph 30 or 31, wherein the injection port comprises a gas inlet, a U-shaped flow path, and a gas outlet.

33. The self-adjusting GLV of any of paragraphs 30 to 32, wherein the reverse-flow check valve comprises a ball and a mesh restrainer.

34. The self-adjusting GLV of any of paragraphs 30 to 33, wherein the self-adjusting GLV fluidically couples an annulus of a well to an interior of a production tubing of the well.

35. The self-adjusting GLV of paragraph 34, wherein the self-adjusting GLV is installed integral to a tubing collar of the production tubing.

36. The self-adjusting GLV of any of paragraphs 30 to 35, wherein the self-adjusting GLV is one of a plurality of self-adjusting GLVs within a self-adjusting gas lift system.

37. The self-adjusting GLV of any of paragraphs 30 to 36, wherein the self-adjusting GLV comprises a high-pressure-differential shear relief valve.

While the present techniques may be susceptible to various modifications and alternative forms, the example examples discussed above have been shown only by way of example. However, it should again be understood that the present techniques are not intended to be limited to the particular examples disclosed herein. Indeed, the present techniques include all alternatives, modifications, and equivalents falling within the true spirit and scope of the appended claims.

What is claimed is:

1. A self-adjusting gas lift system, comprising a plurality of self-adjusting gas lift valves (GLVs) that fluidically couple an annulus of a well to an interior of a production tubing of the well, wherein the self-adjusting gas lift system is initially configured such that the plurality of self-adjusting GLVs allow a compressed gas to flow from the production tubing to the annulus, and wherein each of the plurality of self-adjusting GLVs is configured to:

open to allow the compressed gas to flow between the annulus and the interior of the production tubing when a pressure differential between an injection pressure of the compressed gas and a production pressure of fluids is within an engineered range; and close when the pressure differential is outside the engineered range.

2. The self-adjusting gas lift system of claim 1, wherein each of the plurality of self-adjusting GLVs is configured to close when the pressure differential is outside the engineered range by:

moving to a first closed position when the pressure differential is below the engineered range; and moving to a second closed position when the pressure differential is above the engineered range.

3. The self-adjusting gas lift system of claim 1, wherein the self-adjusting gas lift system is configured to automatically adjust which of the plurality of self-adjusting GLVs are open as the pressure differential fluctuates.

4. The self-adjusting gas lift system of claim 1, wherein each of the plurality of self-adjusting GLVs comprises:

a differential valve;

an injection port; and a reverse-flow check valve.

5. The self-adjusting gas lift system of claim 4, wherein the injection port comprises a gas inlet, a U-shaped flow path, and a gas outlet.

6. The self-adjusting gas lift system of claim 4, wherein the reverse-flow check valve comprises a ball and a mesh restrainer.

7. The self-adjusting gas lift system of claim 1, wherein each of the plurality of self-adjusting GL Vs is installed integral to a respective tubing collar of the production tubing.

8. The self-adjusting gas lift system of claim 1, wherein the self-adjusting gas lift system is subsequently reconfigured such that the plurality of self-adjusting GLVs allow the compressed gas to flow from the annulus to the production tubing during normal operation.

9. A method for lifting hydrocarbon fluids from a well using a self-adjusting gas lift system, comprising:

removing completion fluid from a well by injecting a compressed gas into a production tubing of the well via a plurality of self-adjusting gas lift valves (GLVs) installed along a length of the production tubing, wherein the self-adjusting gas lift system is initially configured such that the plurality of self-adjusting GLVs allow the compressed gas to flow from the production tubing to an annulus of the well, and wherein the compressed gas flows through each of the plurality of self-adjusting GLVs when a pressure differential between an injection pressure of the compressed gas within the annulus and a production pressure of hydrocarbon fluids within the production tubing is within an engineered range; and lifting the hydrocarbon fluids within the production tubing to a surface by injecting the compressed gas into the production tubing via one or more of the plurality of self-adjusting GLVs or an operating valve.

10. The method of claim 9, comprising simultaneously using more than one of the plurality of self-adjusting GLVs to inject the compressed gas into the production tubing.

11. The method of claim 9, comprising automatically adjusting which of the plurality of self-adjusting GLVs are being used to inject the compressed gas into the production tubing as the pressure differential fluctuates.

12. The method of claim 9, comprising:

subsequently reconfiguring the self-adjusting gas lift system such that the plurality of self-adjusting GLVs inject the compressed gas from the annulus into the production tubing during normal operation.

13. A self-adjusting gas lift valve (GLV), comprising:

an injection port;

a differential valve configured to:

allow a compressed gas to flow through the injection port when a pressure differential acting upon the differential valve is within an engineered range; and prevent the compressed gas from flowing through the injection port when the pressure differential acting upon the differential valve is outside the engineered range; and a reverse-flow check valve configured to prevent fluids from flowing backwards through the injection port; and wherein the self-adjusting GLV fluidically couples an annulus of a well to an interior of a production tubing of the well and is initially configured to allow the compressed gas to flow from the production tubing to the annulus.

14. The self-adjusting GLV of claim 13, wherein the differential valve comprise a plug and a spring.

15. The self-adjusting GLV of claim 13, wherein the injection port comprises a gas inlet, a U-shaped flow path, and a gas outlet.

16. The self-adjusting GLV of claim 13, wherein the reverse-flow check valve comprises a ball and a mesh restrainer.

17. The self-adjusting GLV of claim 13, wherein the self-adjusting GLV is subsequently reconfigured to allow the compressed gas to flow from the annulus into the production tubing during normal operation.

18. The self-adjusting GLV of claim 13, wherein the self-adjusting GLV is installed integral to a tubing collar of the production tubing.

19. The self-adjusting GLV of claim 13, wherein the self-adjusting GLV comprises a high-pressure-differential shear relief valve.

* * * * *